United States Patent [19]

Pai et al.

[11] 3,957,431

[45] May 18, 1976

[54] PROCESS FOR EASY-CARE FINISHING CELLULOSICS

[75] Inventors: Panemangalore S. Pai, Charlotte, N.C.; Harro Petersen, Frankenthal; Friedrich Klippel, Ludwigshafen, both of Germany

[73] Assignee: BASF Aktiengesellschaft, Ludwigshafen (Rhine), Germany

[22] Filed: Mar. 28, 1975

[21] Appl. No.: 563,179

[52] U.S. Cl. ..... 8/182; 8/184; 8/195

[51] Int. Cl.[2] ..... D06M 13/34

[58] Field of Search ..... 8/182, 195

[56] References Cited

UNITED STATES PATENTS 3,617,198 11/1971 Reid et al. ..... 8/116.3

OTHER PUBLICATIONS

American Dyestuff Reporter, Vol. 59, No. 6, pp. 26–28, 32 and 34 (June 1970), Reid et al.

*Primary Examiner*—John Kight, III

*Attorney, Agent, or Firm*—Johnston, Keil, Thompson, Shurtleff

[57] ABSTRACT

Process for the easy-care finishing of cellulosics involving low formaldehyde release, wherein the cellulosics, after having been impregnated with a solution of aminoplast-forming substances and dried, are sprayed with a solution of urea.

8 Claims, 2 Drawing Figures

PROCESS FOR EASY-CARE FINISHING CELLULOSICS

Figure 1:
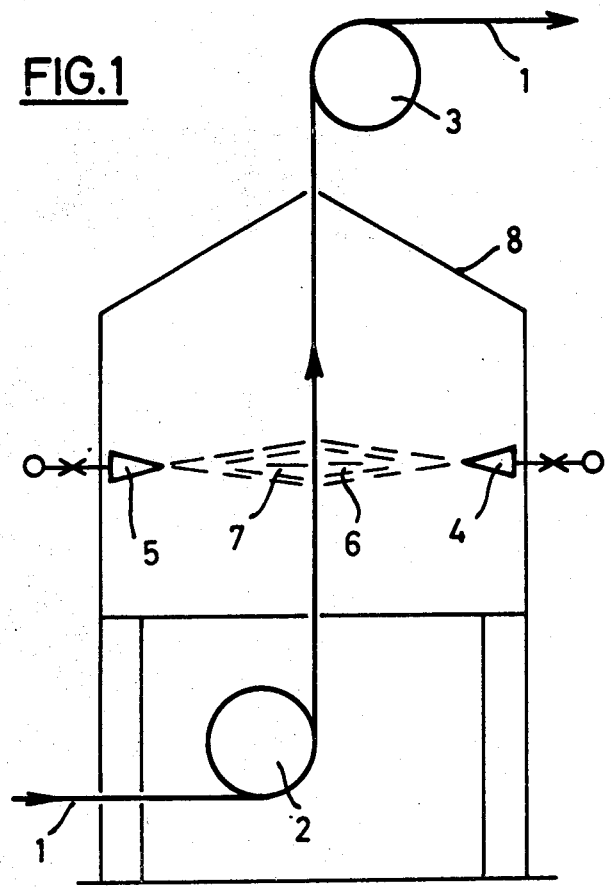

This invention relates to a process for finishing cellulosic textiles in such a way that low formaldehyde release results.

N-methylol compounds are almost exclusively used nowadays for the easy-care finishing of cellulosics. They can be obtained by reaction of formaldehyde with compounds containing amide or imide groups. Such N-methylol compounds will be referred to below as aminoplast-forming substances even though they can be divided into two groups, aminoplast-forming substances in the narrower sense of the term, which at elevated temperatures tend to condense mainly with themselves to form a resin (the aminoplast) and to a lesser degree to react with the cellulose, and the group which preferentially react with the cellulose, thus functioning mainly as crosslinkers, and which show less tendency to condense with themselves to form aminoplast resins. Both groups have their drawbacks but both are in common use. As a rule both reactions occur in parallel so that a strict separation into the two groups is impossible and unnecessary with respect to our invention which aims at preventing or at least reducing the formation of free formaldehyde which occurs with both groups of aminoplast-forming substances.

Particularly important factors in the easy-care (i.e. shrink- and wrinkle-resist) finishing of cellulosic textiles by a post-cure process are the amount of free formaldehyde remaining on the fabrics and the amount of formaldehyde released during storage from fabrics sensitized with N-methylol compounds and catalysts, since formaldehyde may produce a serious odor nuisance in the processing rooms. For the said finishing processes only slow-reacting aminoplast-forming substances of the second (mainly cross-linking) group are suitable, specific examples of which are the methylol compounds of 4,5-dihydroxyethyleneurea. Since undue crosslinking must be avoided during impregnation, drying and storage, the catalysts suitable for post-cure processes are not acids but metal salts, usually zinc nitrate.

Even after a precure process, in which the fixation or condensation of the finishing agent on the fiber takes place immediately after or during the drying step, the risk of slow formaldehyde release cannot be excluded. During storage of the finished fabric in a more or less air-tight package, eg. wrapped in plastic sheeting, a fairly high concentration of free formaldehyde can develop which may be a nuisance for the operator opening the package.

To obtain a coefficient of formaldehyde elimination from fabrics sensitized or finished with N-methylol compounds under extreme conditions of humidity and temperature during storage, use may be made for instance of the AATCC test method*. According to this method, a specimen is stored over water in a sealed jar for 20 hours at 49–50°C. During this period, there is not only diffusion, from the fabric to the aqueous phase, of the free formaldehyde initially present on the fabric when placed in the jar, but further release of formaldehyde from the N-methylol compounds takes place under the catalytic action of the water and the action of the metal salt catalysts. Up to the end of 1972, the AATCC coefficients required by the textile finishers and the processing industry in the United States for sensitized fabrics were less than 2,000 ppm (based on the fabric). Since the beginning of 1973, values of not more than about 1,200 ppm have been required.

*AATCC test method 112–1968, developed in 1965 by AATCC Committee RA68, AATCC Technical Manual.

This has led to the object of the present invention which consists in providing an economical and technically satisfactory easy-care finishing process satisfying these more stringent requirements.

An obvious possibility of reducing the amount of formaldehyde released is to reduce the amount of formaldehyde made available during methylolation of 4,5-dihydroxyethyleneurea. However, on studying the influence of the molar ratio used in the preparation of methylolated 4,5-dihydroxyethyleneureas on the formaldehyde release from sensitized fabrics it is seen that this method does not achieve the desired end, since below a molar ratio of about 1.6 moles of formaldehyde per mole of urea, (or glyoxal) no further reduction in formaldehyde elimination from the fabric is achieved by further reduction of the available formaldehyde. Nor is it possible to reduce the amount of formaldehyde ad lib due to the fact that the N-methylol groups are required to crosslink the cellulose fibers.

Another obvious method of reducing the amount of formaldehyde released is to add a formaldehyde acceptor, for example urea or a urea derivative. It has been found that whilst such additives do have an effect, it is not entirely satisfactory. Urea itself is insufficiently active and in the case of ethyleneurea, which is substantially more active, the additional costs entailed are sufficient to matter. This last remark as a rule applies even more to derivatives of ethyleneurea. In the case of other formaldehyde acceptors, for example oxazolidinone and pyrrolidone, both the above disadvantages as a rule apply, namely a lower activity (because of the lower content of the active constituent, namely the amide nitrogen), and a relatively high cost.

It is an object of the present invention to provide a technically simple and economical process for the easy-care finishing of cellulosic textiles, which gives finished goods with minimal formaldehyde release. A further object of the invention is to provide a process that causes as little interference as possible with existing finishing processes so that it can be carried out on existing plant. A further object of the invention is to provide a process which is more or less universally applicable, ie. the comprehensive range of commercially available finishing agents, having graded properties to suit specific applications, should be retainable with as little change as possible and should not be replaced by one or more new finishing agents. Further objects of the invention will emerge from the text which follows.

We have found that easy-care finished cellulosic textiles which have an exceptionally low tendency to release formaldehyde are obtained simply and economically by slop padding, or preferably spraying, both sides of the textiles, which have been conventionally finished with aminoplast-forming substances and curing catalysts and have been dried, with an effective amount of a solution of a formaldehyde acceptor, preferably with an aqueous urea solution. An effective amount is defined here as an amount which reduces the formaldehyde release from the finished textiles, measured by the above AATCC method, to at most 80%, and preferably at most 25%, of the original value.

The solution applied may be of from 2 to 60%, preferably from 5 to 30%, strength and the amount applied is such that from 0.2 to 4% of formaldehyde acceptor, based on the dry weight of the textile goods, are present on the fibers. It is particularly preferred to apply from 5 to 15% strength, and in particular about 10% strength, urea solutions in an amount of about 10% of the weight of the goods, since this amount of solution on the one hand suffices to wet the surface of the textile goods uniformly, whilst on the other hand it does not moisten the goods excessively. If smaller amounts of more concentrated solutions are used, there is the danger that the goods will not be surface-wetted evenly and the desired effect is not achieved.

It is possible to use other formaldehyde acceptors than urea, which contain the group $$-NH-\overset{\overset{\displaystyle Y}{\|}}{C}-X-$$

in which X is —0—, —NH— or $CH_2$— and Y is NH, S or preferably 0, and which have a molecular weight of less than 200, preferably less than 100, the choice of the remaining part of the molecule being virtually only restricted by the obvious prerequisite of sufficient solubility in water, as well as by the cost of the product and the proviso that groups which cause discoloration (directly, or during fixation by the post-cure process) or evolution of odors must be absent; amongst such other compounds, cyclic compounds, especially 5-membered ring compounds, such as ethyleneurea, 1,3-oxazolidine-2-one, pyrrolidone-2, 4-methylethyleneurea, 4,5-dimethylethyleneurea and 4,5-dihydroxyethyleneurea, are preferred. The reason why 5-membered ring compounds are preferred is their great affinity for formaldehyde. In such compounds, the amide nitrogen reacts particularly rapidly and completely with formaldehyde. Other examples of usable aldehyde acceptors are methylurea, N,N- and N,N'-dimethylurea, propyleneurea, thiourea, dicyandiamide and mineral acid salts of guanidine, for example the carbonate or sulfate. The amount applied to the fibers must in each case be chosen in accordance with the activity of the particular substance but is again within the above range of from 0.2 to 4%. Urea is the most economical formaldehyde acceptor and is at the same time sufficiently active, and accordingly is particularly preferred.

The spraying or padding with the formaldehyde acceptor solution is carried out after drying and, in the post-cure process, preferably before fixation (though in principle it would of course also be possible to carry it out after fixation, except that in such a case the formaldehyde release up to the fixation stage would have to be tolerated); in the pre-cure process spraying or padding are suitably carried out after fixation, with a view to greatest effectiveness. Surprisingly, the effect produced by the new measure is several times that achieved by adding the same, or even a several times greater, amount of formaldehyde acceptor to the finishing solution.

The finishes are applied by impregnating the textiles with a liquor containing, in addition to the usual condensation catalysts in the usual amounts (about 0.1 to 2% by weight) and possibly other conventional finishing agents and auxiliaries, an amount of finishing agent such that the solids content of aminoplast-forming substances in the liquor is from 5 to 25% and preferably from 7 to 15% by weight, squeezing or centrifuging the fabric to the desired wet pick-up and drying and effecting condensation in conventional manner.

Examples of specific, conventional catalysts for the condensation are potentially acidic salts such as ammonium salts of strong acids, and also magnesium chloride, zinc chloride and, in particular, zinc nitrate. Mixtures of two or more catalysts may also be used. Usual amounts of catalysts are from 1 to 40 g/l of impregnating liquor.

Examples of suitable aminoplast-forming substances, in the sense of the introductory comments, are the methylol compounds and alkoxymethyl compounds of acyclic and cyclic ureas, that is to say of urea, thiourea, ethyleneurea, propyleneurea, glyoxalmonourein, triazinones and urones, of monocarbamic and dicarbamic acid esters, cyanamide and dicyanamide and aminotriazines; amongst the latter, the methoxymethyl compounds of melamine are preferred.

The finishing agents may additionally contain other conventional agents such as flameproofing agents, water and oil repellents, antistatic agents, resin finishes, dyes, pigments and binders and also conventional auxiliaries such as softeners, catalysts, dyeing assistants, buffer substances, wetting agents and the like. Examples of water repellents are aluminum-containing and zirconium-containing paraffin wax emulsions, silicone-containing formulations and perfluorinated aliphatic compounds. Examples of softeners are ethoxylation products of higher fatty acids, fatty alcohols and fatty acid amides, high molecular weight polyglycol ethers, higher fatty acids, fatty alcohol sulfonates, N-stearyl-N,N'-ethyleneurea and stearylamidomethylpyridinium chloride. Examples of levelers are water-soluble salts of acid esters of polybasic acids with ethylene oxide adducts or propylene oxide adducts of relatively long-chain alkoxylatable alkaline substances. Examples of wetting agents are salts of alkylnaphthalenesulfonic acids, the alkali metal salts of sulfonated dioctyl succinate and the adducts of alkylene oxides and fatty alcohols, alkyl phenols, fatty amines and the like. Examples of resin finishes are cellulose ethers and cellulose esters and alginates and also solutions or dispersions of synthetic polymers and polycondensates, e.g., polyethylene, polyamides, ethoxylated polyamides, polyvinyl ethers, polyvinyl alcohols, polyacrylic acid or its esters or amides and also corresponding polymethacrylic compounds, polyvinyl propionate, polyvinylpyrrolidone and copolymers, for example copolymers of vinyl chloride and acrylates, of butadiene and styrene or acrylonitrile or of $\alpha$-dichloroethylene, $\beta$-chloroalkyl acrylates or vinyl ethyl ether and acrylamide or the amides of crotonic acid or maleic acid or of N-methylol-methacrylamide and other polymerizable compounds. These additional additives are generally used in amounts of from 0.3 to 4% and preferably from 1 to 2.5% by weight of the weight of dry textile material. However, these percentages may be exceeded in certain cases.

The concentration of the finishing liquor depends on the wet pick-up and on the desired rate of application of the aminoplastforming substances. This, in turn, is governed by the effect required and is usually from 3 to 12% and preferably from 5 to 8% by weight of the dry weight of fibrous material.

Impregnation may be carried out in any desired manner, for example by spraying, spreading or, particularly, by dipping. We prefer to use a padding machine for this purpose. The squeezed or centrifuged material is then dried at from 90° to 140°C so as to give a residual moisture content of up to 20% and preferably from 1 to 8%.

Figure 2:
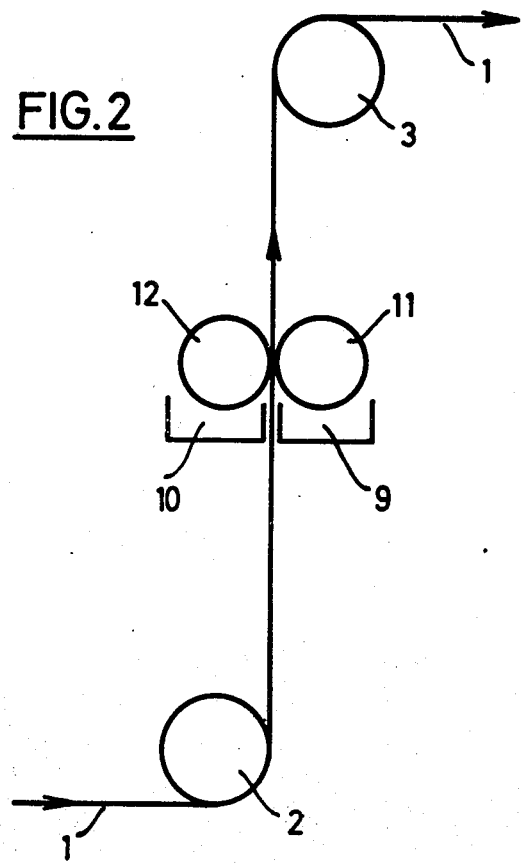

According to the invention, the urea solution (or solution of another formaldehyde accentor) is evenly sprayed or slop padded onto both sides of the web. The expenditure for equipment required to carry out this process, especially for spraying, is low, as can be seen from the accompanying diagrammatic drawings in which FIGS. 1 and 2 illustrate preferred embodiments of the method of carrying out the process of the invention, FIGS. 1 and 2 showing cross-sectional views of a spraying means and a slop padding means, respectively.

Referring to the drawing, a textile web 1 dried in the manner described above is supplied via a deflecting roller 2 to that portion of the apparatus in which the solution of the aldehyde acceptor is applied to the web, and on leaving the said apparatus runs over deflecting roller 3 for further treatment or storage as explained further below.

In order to apply the solution of formaldehyde acceptor by spraying, a plurality of spray nozzles (4,5) may be provided on both sides of the web between rollers 2 and 3, the jets (6,7) of atomized acceptor solution being directed against the web. The said spray means may include an enclosure 8 to contain the mist not taken up by the fabric. A suitable position of the nozzles would be such as to produce a substantially horizontal jet against the web moving in a vertical plane. Slop padding can be carried out with a similar apparatus, wherein the spray nozzles are replaced in accordance with FIG. 2 by padding rollers 11 and 12 with appropriate troughs 9 and 10 for the formaldehyde acceptor solution. Enclosure 8 can in that case be omitted.

The moisture content of the goods increases to from about 5 to 30 per cent by weight, preferably from about 6 to 15 per cent by weight, during spraying or padding. Some of the moisture introduced evaporates spontaneously. Depending on the desired residual moisture content, the goods can be left as such or be dried once more. Material thus sensitized may be stored for a number of months and made up into garments before condensation is carried out at temperatures of from 160° to 175°C (post-cure process, in which the advantages of the invention are particularly evident). Alternatively, condensation (fixation) may be carried out in the pre-cure process immediately after drying (pad-dry-curing technique) or at the same time as drying (rapid curing or flash curing) at temperatures of from 140° to 220°C, i.e. before spraying with the formaldehyde acceptor solution.

Cellulosic textiles thus finished are permanently wrinkle-resistant and shrink-resistant and any embossing effects or pleats made before or during condensation are fairly durable to laundering, and as a result of the treatment with the formaldehyde acceptor solution, the release of formaldehyde is reduced to a minimum.

Of course, other textile assistants can also be added to the formaldehyde acceptor solution, for example softeners, finishing agents, water and oil repellents, antistatic agents, flameproofing agents and the like, of the type mentioned above, in order to improve the properties of the finished textile goods in other respects also, without entailing an additional process step. This will be of interest especially in cases where the addition of the textile assistants to the finishing liquor appears inadvisable for some reason.

The process according to the invention may be used for finishing textiles, eg. woven fabrics, knitted fabrics or non-wovens, which contain cellulose fibers (or regenerated cellulose fibers) in addition to any other textile fibers, in particular polyester fibers, or which consist entirely of cellulose fibers.

In the following Examples the parts and percentages are by weight.

EXAMPLE 1 a. A 65/35 polyester/rayon staple fabric is impregnated on a padder with a liquor which contains 200 parts of a 45% strength dimethylolglyoxalmonourein product and 40 parts of a 25% strength solution of anhydrous zinc nitrate per 1,000 parts of liquor, the liquor pick-up being 70%, and is dried for 60 seconds at 140°C and then subjected to condensation for 30 seconds at 160°C.

The formaldehyde release is measured both by the AATCC test method and by the method developed by Petersen[1]. The results are shown in Table 1.

[1]H. Petersen, Wechselwirkung von Vernetzern und Katalysatoren in der Hochveredlung, 10th communication, Melliand Textilber. 54 (1973), pp. 415–418, 520–532 529–669–675.

b. A 65/35 polyester/rayon staple fabric is impregnated with a liquor which contains 200 parts of a 45% strength dimethylolglyoxalmonourein product, 15 parts of urea and 40 parts of a 25% strength solution of anhydrous zinc nitrate per 1,000 parts of liquor and squeezed to a liquor pick-up of 70% of a padder. The drying and condensation conditions are those of experiment a.

The formaldehyde release is determined by the two methods mentioned under (a). The results obtained are shown in Table 1.

c. A 65/35 polyester/rayon staple fabric which has been finished as in experiment a is sprayed, after fixation, with a 10% strength urea solution until the weight increase is 10%. Accordingly, the amount of urea applied to the fibrous material is 1 per cent by weight, as in experiment b. The formaldehyde release is determined by the two methods mentioned under (a). The results obtained are shown in Table 1.

TABLE 1

Effect of added urea on formaldehyde release from a polyester/rayon staple fabric finished with dimethylolglyoxalmonourein and zinc nitrate as the catalyst

| Experiment | a | b | c |
|---|---|---|---|
| Dimethylolglyoxalmonourein (g/l) | 200 | 200 | 200 |
| Zinc nitrate solution (g/l) | 40 | 40 | 40 |
| Added urea (g/l) | — | 15 | — |
| Amount, in % based on fabric, of 10% strength urea solution, applied by spraying | — | — | 10 |
| Free formaldehyde, based on fabric, present on the fabric, as determined by the Petersen method | Mean value (ppm) 80 | Mean value (ppm) 20 | Mean value (ppm) 19 |
| Formaldehyde, in ppm, based on fabric, | 960 | 390 | 220 |

TABLE 1-continued

Effect of added urea on formaldehyde release from a polyester/rayon staple fabric finished with dimethylolglyoxalmonourein and zinc nitrate as the catalyst

| Experiment | a | b | c |
|---|---|---|---|
| determined by the AATCC method | | | |

EXAMPLE 2

Experiments 1*b* and *c* are carried out with the same amounts (ie. 1%, based on fibrous material) of ethyleneurea in place of urea.

EXAMPLE 3

Experiments 1*b* and *c* are carried out with the same amounts (ie. 1%, based on fibrous material) of pyrrolidone in place of urea.

EXAMPLE 4

Experiments 1*b* and *c* are carried out with the same amounts (ie. 1%, based on fibrous material) of 3-oxazolidin-2-one in place of urea.

EXAMPLE 5

Experiment 1*b* is carried out with the same amount (ie. 1%, based on fibrous material) of thiourea in place of urea.

EXAMPLE 6

Experiment 1*b* is carried out with the same amount (ie. 1%, based on fibrous material) of guanidine carbonate in place of urea.

EXAMPLE 7

Experiment 1*b* is carried out with the same amount (ie. 1%, based on fibrous material) of dicyandiamide in place of urea.

The results obtained are shown in Table 2.

EXAMPLE 8 a. A 65/35 polyester/rayon staple fabric is impregnated with a liquor which contains 200 parts of a 45% strength dimethylolglyoxalmonourein product and, as the catalyst, 40 parts of an aqueous solution containing 25 per cent by weight of magnesium sulfate heptahydrate and 25 per cent by weight of primary magnesium phosphate, per 1,000 parts of liquor, and is squeezed to give a liquor pick-up of 70%. It is then dried for 60 seconds at 140°C after which it is subjected to condensation for 30 seconds at 160°C.

The measurements of the formaldehyde release are carried out both by the AATCC method and by the Petersen method. The results obtained are shown in Table 3.

b. A 65/35 polyester/viscose staple woven fabric is impregnated with a liquor containing 200 parts of a 45% strength dimethylolglyoxal product, 40 parts of the catalyst mentioned under (a) and 15 parts of urea per 1,000 parts of liquor and is squeezed to give a liquor pick-up of 70%. It is then dried, and subjected to condensation, in accordance with the conditions mentioned under (a), and the formaldehyde release is measured. The results obtained are shown in Table 3.

c. A 65/35 polyester/rayon staple fabric treated analogously to experiment (a) is sprayed, after condensation, with a 10% strength urea solution until the weight increase is 10%. The formaldehyde release is measured by both the methods mentioned. The results are shown in Table 3.

TABLE 2

Effect of adding various formaldehyde acceptors on the formaldehyde release from a polyester/rayon staple fabric finished with dimethylolglyoxalmonourein (= dimethylol-4,5-dihydroxyethyleneurea) and zinc nitrate as the catalyst

| Example | 1 | 2 | | 3 | | 4 | | 5 | 6 | 7 |
|---|---|---|---|---|---|---|---|---|---|---|
| Aldehyde acceptor | | Ethylene-urea | | Pyrroli-done | | Oxazoli-dinone | | Thiourea | Guani-dine carbonate | Dicyan-diamide |
| Experiment | a | b | c | b | c | b | c | c | c | c |
| Free formaldehyde on the fabric, expressed in ppm based on fabric, determined by the Petersen method | 80 | 30 | 17 | 28 | 23 | 32 | 25 | 28 | 31 | 29 |
| Formaldehyde determined by the AATCC method, mean values expressed in ppm, based on fabric | 960 | 400 | 190 | 410 | 230 | 405 | 235 | 230 | 275 | 250 |

In Example 2b, 3b and 4b, 15 parts of the particular aldehyde acceptor were added to the finishing liquor, analogously to Example 1b.
In Examples 2c, 3c, 4c, 5c, 6c and 7c, the fabric finished according to Example 1a was sprayed, analogously to Example 1c, with a 10% strength aqueous solution of the particular formaldehyde acceptor until the weight increase was 10%.

TABLE 3

Effect of added urea on formaldehyde release from a polyester/rayon staple fabric finished with dimethylolglyoxalmonourein and the catalyst described under experiment 5a

| Experiment | a | b | c |
|---|---|---|---|
| Dimethylolglyoxalmonourein (g/l) | 200 | 200 | 200 |
| Catalyst solution (g/l) | 40 | 40 | 40 |
| Added urea (g/l) | — | 15 | — |
| Amount, in % based on fabric, of 10% strength urea solution, applied by spraying | — | — | 10 |

TABLE 3-continued

Effect of added urea on formaldehyde release from a polyester/rayon staple fabric finished with dimethylolglyoxalmonourein and the catalyst described under experiment 5a

| Experiment | a | b | c |
|---|---|---|---|
| Free formaldehyde on the fabric, mean value in ppm based on fabric, as determined by the Petersen method | 60 | 47 | 18 |
| Formaldehyde, mean value in ppm based on fabric determined by the AATCC method | 1,300 | 750 | 77 |

EXAMPLE 9 a. A 65/35 polyester/rayon staple fabric is impregnated with a liquor which contains 200 parts of an aqueous 50% strength dimethylol-4-methoxy-5,5-dimethylpropyleneurea solution and 40 parts of a 25% strength solution of anhydrous zinc nitrate per 1,000 parts of liquor and squeezed to 70% liquor pick-up on a padder. The drying and condensation are carried out as in Example 1. The formaldehyde measurements are made by both the methods mentioned and the results are recorded in Table 4.

b and c. Analogously to Examples 1 b and *c*, either 15 parts of urea are added to the liquor of the above composition, or the urea solution described in Example 1 *c* is sprayed onto the fabric after condensation. The formaldehyde release of the fabrics treated in this way is tested by the methods mentioned and the results obtained are shown in Table 4.

TABLE 4

Effect of added urea on formaldehyde release from a polyester/rayon staple fabric finished with dimethylol-4-methoxy-5,5-dimethylpropyleneurea

| Experiment | a | b | c |
|---|---|---|---|
| Dimethylol-4-methoxy-5,5-dimethyl-propyleneurea (g/l) | 200 | 200 | 200 |
| Zinc nitrate solution (g/l) | 40 | 40 | 40 |
| Added urea (g/l) | — | 15 | — |
| Amount, in % based on fabric, of 10% strength urea solution, applied by spraying | — | — | 10 |
| Free formaldehyde on the fabric, mean value in ppm based on fabric, as determined by the Petersen method | 300 | 45 | 0 |
| Formaldehyde, mean value in ppm based on fabric, determined by AATCC method | 2,130 | 930 | 860 |

EXAMPLE 10 a. A 65/35 polyester/rayon staple fabric is impregnated with a liquor which contains 200 parts of a 50% strength dimethylolmethoxyethyl carbamate solution and 40 parts of a 25% strength solution of anhydrous zinc nitrate per 1,000 parts of liquor and squeezed to 70% liquor pick-up on a padder. The drying and condensation are carried out as in Example 1. Equally, the formaldehyde release is measured by the methods of Example 1, and the values obtained are shown in Table 5.

b and c. Analogously to Examples 1 *b* and *c*, either 15 parts of urea are added to the liquor of the above composition (Experiment a), or the urea solution described in Example 1 *c* is sprayed onto the fabric after condensation. The formaldehyde release of the fabrics treated in this way is tested by the methods mentioned and the results obtained are shown in Table 5.

TABLE 5

Effect of added urea on formaldehyde release from a polyester/viscose staple fabric finished with dimethylolmethoxyethyl carbamate

| Experiment | a | b | c |
|---|---|---|---|
| Dimethylolmethoxyethyl carbamate (g/l) | 200 | 200 | 200 |
| Zinc nitrate solution (g/l) | 40 | 40 | 40 |
| Added urea (g/l) | — | 15 | — |
| Amount, in % based on fabric, of 10% strength urea solution, applied by spraying | | — | 10 |
| Free formaldehyde on the fabric, mean value in ppm based on fabric, as determined by the Petersen method | 150 | 50 | 0 |
| Formaldehyde, mean value in ppm based on fabric, determined by the AATCC method | 980 | 830 | 350 |

EXAMPLE 11 a. A 65/35 polyester/rayon staple fabric is impregnated with a liquor which contains 200 parts of an aqueous 45% strength dimethoxymethylurea solution and 40 parts of a 25% strength solution of anhydrous zinc nitrate per 1,000 parts of liquor and squeezed to 70% liquor pick-up on a padder. Drying and condensation are carried out as in Example 1. The formaldehyde release is measured by the two methods mentioned earlier and the results obtained are shown in Table 6.

b. 15 parts of urea are added to the liquor of the composition used in Experiment (a), before impregnating the fabric; in other respects, the procedure followed is as in (a).

c. The fabric treated as in Experiment (a) is sprayed with a 10% strength urea solution until the weight increase is 10%.

The measured values of the formaldehyde release are shown in Table 6.

TABLE 6

Effect of added urea on formaldehyde release from a polyester/rayon staple fabric finished with dimethoxymethylurea

| Experiment | a | b | c |
|---|---|---|---|
| Dimethoxymethylurea (g/l) | 200 | 200 | 200 |
| Zinc nitrate solution (g/l) | 40 | 40 | 40 |
| Added urea (g/l) | — | 15 | — |
| Amount, in % based on fabric, of 10% strength urea solution, applied by spraying | — | — | 10 |
| Free formaldehyde on the fabric, mean value in ppm based on fabric, as determined by the Peterson method | 205 | 60 | 40 |
| Formaldehyde, mean value in ppm based on fabric, determined by the AATCC method | 4,160 | 1,600 | 660 |

EXAMPLE 12 a. A pure cotton woven fabric is impregnated with a liquor which contains 200 parts of dimethylol-4-methoxy-5,5-dimethylolpropyleneurea and 40 parts of a 25% strength solution of anhydrous zinc nitrate per 1,000 parts of liquor, squeezed to 70% liquor pick-up on a padder, dried for 60 seconds at 140°C and subjected to condensation at 160°C for 3 minutes. The formaldehyde release is measured by the two methods mentioned and the results are shown in Table 7.

b. The 100% cotton fabric used in Experiment (a) is finished as in (a) and then washed in accordance with the following program:

2 parts of a commercial detergent and 2 parts of anhydrous sodium carbonate are made up to 1,000 parts with water, the fabric is treated with this solution for 5 minutes at 60°C and is then rinsed 3 times (at 60°C, at 40°C and with cold water). After testing the neutrality with pH paper the fabric is dried. The formaldehyde release is measured by the methods mentioned and the values obtained are shown in Table 7.

c. 15 parts of urea are added to the liquor of the composition used in Experiment a), before carrying out the treatment of the 100% cotton fabric.

d. A 100% cotton fabric treated as in Experiment (a) is sprayed with a 10% strength urea solution until the weight increase is 10%.

The formaldehyde release is measured by the methods mentioned and the results are recorded in Table 7.

TABLE 7

Effect of various measures on formaldehyde release from a 100% cotton fabric finished with dimethylol-4-methoxy-5,5-dimethylolpropyleneurea

| Experiment | Free formaldehyde on the fabric, mean value in ppm based on fabric, as determined by the Petersen method | Formaldehyde, mean value in ppm based on fabric, determined by the AATCC method |
|---|---|---|
| a (Untreated) | 300 | 2,120 |
| b (Washed) | 95 | 945 |
| c (With added urea) | 45 | 930 |
| d (Sprayed) | 0 | 860 |

EXAMPLE 13

A fabric of 67% of polyester and 33% of cotton is treated as in Examples 12 *a* to *d*. The measured values of formaldehyde release are shown in Table 8.

TABLE 8

Effect of added urea on the formaldehyde release from a 67:33 polyester/cotton fabric finished with dimethylol-4-methoxy-5,5-dimethylolpropyleneurea

| Experiment | Free formaldehyde on the fabric, mean value in ppm based on fabric, as determined by the Petersen method | Formaldehyde, mean value in ppm based on fabric, determined by the AATCC method |
|---|---|---|
| a | 220 | 2,200 |
| b | 115 | 950 |
| c | 50 | 920 |
| d | 0 | 830 |

EXAMPLE 14

A 67:33 polyester/cotton fabric is impregnated on a padder with a liquor which contains 200 parts of a 45% strength aqueous solution of dimethylol-glyoxal-monourein and 40 parts of a 25% strength aqueous solution of anhydrous zinc nitrate per 1,000 parts of liquor, squeezed to give a liquor pick-up of 70%, dried for 60 seconds at 140°C and then subjected to condensation at 160°C for 3 minutes. The goods thus treated are divided into portions which are sprayed with urea solutions of different concentration so as to give fabric samples containing 0.5%, 1%, 2%, 3% and 4% of urea, based on weight of goods. For formaldehyde release is measured by the methods mentioned. The values obtained are shown in Table 9.

TABLE 9

Effect of the amount of urea sprayed onto the fabric on the formaldehyde release from a polyester/cotton fabric finished with dimethylolglyoxalmonourein

| | Free formaldehyde measured by the Petersen method Mean value in ppm | Free formaldehyde measured by the AATCC method Mean value in ppm |
|---|---|---|
| 200 parts of 45% strength dimethylolglyoxalmonourein 40 parts of 25% strength zinc nitrate solution | 60 | 600 |
| Sprayed with urea solution Amount of urea applied, based on fabric: 0.5% | 0 | 450 |
| 1% | 0 | 300 |
| 2% | 0 | 258 |
| 3% | 0 | 90 |
| 4% | 0 | 60 |

EXAMPLE 15

A 65:35 polyester/cotton fabric is impregnated with a liquor which contains 200 parts of a 45% strength commercial dimethylolurea product and 40 parts of a 25% strength solution of anhydrous zinc nitrate per 1,000 parts of liquor and is squeezed on a padder to give a liquor pick-up of 70%.

The drying, condensation and treatment with urea solutions are carried out under the conditions described in Example 14. The formaldehyde release is measured by the methods mentioned and the results are recorded in Table 10.

TABLE 10

Effect of the amount of urea sprayed onto the fabric on the formaldehyde release from a polyester/cotton fabric finished with a commercial dimethylolurea product

| | Free formaldehyde measured by the Peterson method Mean value in ppm | Free formaldehyde measured by the AATCC method Mean value in ppm |
|---|---|---|
| 200 parts of 45% strength dimethylolurea 40 parts of 25% strength zinc nitrate solution Sprayed with urea solution. Amount of urea applied, based on fabric: 0.5% | 100 | 1,880 |
| 1% | 0 | 1,480 |
| 2% | 0 | 670 |
| 3% | 0 | 340 |
| 4% | 0 | 360 |
| | 0 | 450 |

EXAMPLE 16

A polyester/cotton fabric treated as in Example 14 is padded, after having been finished, with a 2.5% strength urea solution to give a weight increase of 40%, and is then dried. The formaldehyde release is measured by the methods mentioned and the results are recorded in Table 11.

EXAMPLE 17

A polyester/cotton fabric is finished as in Example 15 and then padded by the method described in Example 16. The resulting values of the formaldehyde release are also recorded in Table 11.

TABLE 11

Effect of padding a finished polyester/cotton fabric with a urea solution on the formaldehyde release

| | | Free formaldehyde measured by the Petersen method Mean value in ppm | Free formaldehyde measured by the AATCC method Mean value in ppm |
|---|---|---|---|
| Example 16 | 200 parts of 45% strength dimethylolglyoxalmonourein 40 parts of 25% strength zinc nitrate solution | 60 | 600 |
| | Padded with a 2.5% strength urea solution to give a weight increase of 40%, based on the fabric | 0 | 240 |

TABLE 11-continued

Effect of padding a finished polyester/cotton fabric with a urea solution on the formaldehyde release

| | | Free formaldehyde measured by the Petersen method Mean value in ppm | Free formaldehyde measured by the AATCC method Mean value in ppm |
|---|---|---|---|
| Example 17 | 200 parts of 45% strength dimethylolurea 40 parts of 25% strength zinc nitrate solution | 100 | 1,880 |
| | Padded with a 2.5% strength urea solution to give a weight increase of 40%, based on the fabric | 0 | 1,160 |

We claim:

1. In a process for the easy-care finishing of cellulosic textile material by impregnating said material with an aqueous solution of aminoplast-forming substances and drying and fixation, the improvement which comprises diminishing the release of free formaldehyde from the finished material by spraying or slop padding said material, after impregnation and drying, with an effective amount of an essentially aqueous 2 to 60% strength by weight solution of a formaldehyde acceptor in the form of a compound which has a molecular weight of less than 200 and contains the group

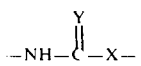

wherein X is $-O-$, $-NH-$ or $-CH_2-$ and Y is O, NH or S.

2. The improvement as claimed in claim 1, wherein the formaldehyde acceptor contains the group

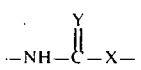

in a five-membered ring.

3. The improvement as claimed in claim 1, wherein the post-cure process is used and the textiles are impregnated, dried, sprayed or slop padded with the formaldehyde acceptor solution and only then fixed.

4. The improvement as claimed in claim 1, wherein the pre-cure process is used and the textiles are finished and after fixation are sprayed or slop padded with the formaldehyde acceptor solution.

5. The improvement as claimed in claim 1, wherein the formaldehyde acceptor employed is one of the following: urea, ethyleneurea, 4-methylethyleneurea, 4,5-dimethylethyleneurea, 4,5-dihydroxyethyleneurea, 1,3-oxazolidin-2-one, pyrrolidone-2, propyleneurea, monomethylurea, dimethylurea, thiourea, a guanidine salt of a mineral acid and dicyandiamide.

6. The improvement as claimed in claim, wherein urea is employed as the formaldehyde acceptor.

7. The improvement as claimed in claim 1, wherein from 2.0 to 4 per cent by weight of formaldehyde acceptor is applied to the fibrous material.

8. The improvement as claimed in claim 6, wherein from 0.2 to 4 per cent by weight of urea are applied to the fibrous material.

* * * * *

UNITED STATES PATENT AND TRADEMARK OFFICE

CERTIFICATE OF CORRECTION

PATENT NO. : 3,957,431

DATED : May 18, 1976

INVENTOR(S) : Panemangalore S. Pai; Harro Petersen & Friedrich Klippel

It is certified that error appears in the above-identified patent and that said Letters Patent are hereby corrected as shown below:

Claim 6, line 1, after "claim" insert --1--.

Signed and Sealed this

*Thirtieth* Day of *December 1980*

[SEAL]

*Attest:*

SIDNEY A. DIAMOND

*Attesting Officer*

*Commissioner of Patents and Trademarks*